United States Patent [19]

Nagano et al.

[11] 4,153,026

[45] May 8, 1979

[54] CARBURETOR FOR STRATIFIED CHARGE COMBUSTION ENGINE

[75] Inventors: Masami Nagano; Satosi Suzuki, both of Katsuta, Japan

[73] Assignee: Hitachi, Ltd., Japan

[21] Appl. No.: 744,398

[22] Filed: Nov. 23, 1976

[30] Foreign Application Priority Data

Nov. 25, 1975 [JP] Japan ..... 50-140152

[51] Int. Cl.[2] ..... F02M 59/00

[52] U.S. Cl. ..... 123/139 AW; 123/75 B

[58] Field of Search ..... 123/32 ST, 139 AW, 75 B; 137/494, 510; 239/533.3, 533.6

[56] References Cited

U.S. PATENT DOCUMENTS

| | | | |
|---|---|---|---|
| 2,043,798 | 6/1936 | Hyatt | 137/510 |
| 2,447,695 | 8/1948 | Folke | 137/510 |
| 2,893,712 | 7/1959 | Huse | 123/139 AW |
| 2,957,467 | 10/1960 | Ball | 123/139 AW |
| 2,989,065 | 6/1961 | McDurffie | 123/139 AW |
| 4,002,153 | 1/1977 | Moriya et al. | 123/139 AW |
| 4,038,957 | 8/1977 | Hosho et al. | 123/139 AW |

*Primary Examiner*—Charles J. Myhre
*Assistant Examiner*—David D. Reynolds
*Attorney, Agent, or Firm*—Craig & Antonelli

[57] ABSTRACT

Construction of a carburetor used in a stratified charge combustion engine, wherein: flow division control means are dispensed with; and a main and an auxiliary discharge valves are made to have the flow division control functions by themselves, that is, air-fuel ratios of mixtures produced in a main air intake passage and an auxiliary air intake passage, respectively, are adapted to be varied in response to the change of the flow rate of intake air into the associated engine by changing the respective flow rate characteristics of the main and auxiliary discharge valves; thereby eliminating the drawback of decreased accuracy in actual operation of a carburetor used in a stratified charge combustion engine having said flow division control means.

4 Claims, 11 Drawing Figures

CARBURETOR FOR STRATIFIED CHARGE COMBUSTION ENGINE

BACKGROUND OF THE INVENTION

The present invention relates to the carburetors for so-called stratified charge combustion engines in which charges of lean air-fuel mixture and rich air-fuel mixture are fed to the combustion chamber of an engine, the rich air-fuel mixture is ignited and the resulting combustion flame leads to the combustion of the whole air-fuel mixture.

The carburetor for feeding the air-fuel mixture to the stratified charge combustion engine should produce the lean air-fuel mixture and the rich air-fuel mixture separately from each other, and further, the respective air-fuel mixtures should be varied dependent upon the operating conditions of the engine, that is, mainly upon the flow rate of intake air of the engine, and indirectly upon the opening degrees of throttle valves.

In order to meet the above requirements, in the specification of Japanese Patent Application No. 105998/75 there has been proposed a carburetor for the stratified charge combustion engine in which a supply of fuel from a fuel pressure control valve for changing pressure difference between the portions upstream and downstream of a metering jet in response to the variation of negative pressure generated at a venturi portion of an air intake passage, is supplied to a main discharge valve and an auxiliary discharge value respectively provided in a main air intake passage and an auxiliary air intake passage both disposed downstream of the venturi portion of said intake passage, by being devided while passing through flow division control means including a jet needle and a jet needle orifice and controlled in proportion to the movements of a main throttle valve and an auxiliary throttle valve respectively provided in said main and auxiliary intake passages and linked with each other.

With the arrangement described, theoretically highly accurate control can be expected. However, in practice there have been such disadvantages that the accuracy in the ratio between the divided flows is largely influenced by the accuracies of finishing of the jet needle and jet orifice used in the flow division control means, and further, the accuracy in control is decreased by gaps formed within the interlocking mechanism because the flow division control means is interlocked with the main and auxiliary throttle valves by means of links and the like.

SUMMARY OF THE INVENTION

The object of the present invention is to dispense with the flow division control means and to make the discharge valves have the flow division control functions by themselves, thereby eliminating the drawbacks described.

According to the present invention, a carburetor for a stratified charge combustion engine wherein a fuel pressure control valve is provided which is adapted to change a pressure difference between the portions upstream and downstream of a metering jet in proportion to the variation of negative pressure produced at a venturi portion provided in a passage for feeding air to an associated engine and a supply of fuel passing through the metering jet is divided and respectively supplied to a diaphragm type main discharge valve and a diaphragm type auxiliary discharge valve respectively provided in a main air intake passage and an auxiliary air intake passage both of which are provided at the downstream of said venturi portion, characterized in that: air-fuel ratios of mixtures produced in the main air intake passage and the auxiliary air intake passage, respectively, are adapted to be changed in response to the change of flow rate of intake air into the engine by changing the respective flow rate characteristics of the main and auxiliary discharge valves can be provided.

DESCRIPTION OF THE PREFERRED EMBODIMENTS

Figure 1:
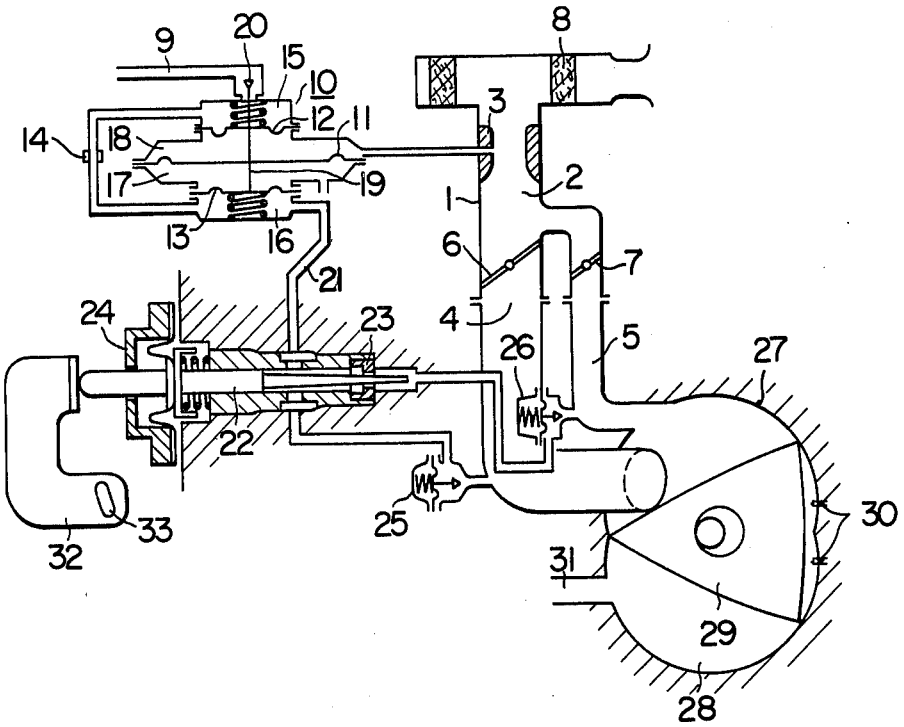
FIG. 1 PRIOR ART
FIG. 1 is a cross-sectional view showing the fuel system in the conventional stratified charge combustion engine.

FIG. 1 illustrates the prior art described in the above-cited Patent Application No. 105998/75. Designated at 1 is the body proper of a carburetor having an air intake passage 2. Provided in said air intake passage is a venturi portion 3. The air intake passage 2 is divided into two sections including a main air intake passage 4 and an auxiliary air intake passage 5 at a portion downstream of the venturi portion 3, and said both air intake passages are respectively provided therein with a main throttle valve 6 and an auxiliary throttle valve 7 which are interlocked with each other by means of links. Designated at 8 is an air cleaner provided at the top portion of the air intake passage 2.

A supply of fuel from a fuel tank is pressurized by a pump, passes through a filter and a fuel pressure regulator (all not shown), and is led to fuel pressure control valve means 10 for performing the air-fuel ratio control of the carburetor through a fuel feed pipe 9 under a certain positive pressure regulated by the fuel pressure regulator. Said fuel pressure control valve means 10 is partitioned into four compartments by three diaphragms including a large diaphragm 11 and two small diaphragms 12, 13, said four compartments including a compartment 15 upstream of a metering jet 14 for metering the total fuel flow rate, a compartment 16 downstream of said metering jet 14, an atmospheric compartment 17 and a negative pressure compartment 18 to which is led negative pressure from the venturi portion 3 for detecting intake air flow rate to the associated engine. Secured to the centers of the three diaphragms is a rod 19. Provided at the forward end of the rod 19 is a valve 20 adapted to be automatically controlled so that the negative pressure at the venturi portion and the pressure difference between the upstream and downstream portions of the metering jet 14 may be balanced.

A supply of fuel metered by the metering jet 14 is led to the flow division control means 24 comprising a jet needle 22, a jet needle orifice 23 and the like through a passageway 21, the sectional area of a passageway for the supply of fuel fed to an auxiliary discharge valve 26 provided in the auxiliary air intake passage 5 is controlled by the jet needle 22 and the jet needle orifice 23, the supply of fuel is divided into the main discharge valve 25 and the auxiliary discharge valve 26 at a predetermined ratio by supplying the remaining fuel not passing through the orifice 23 to the main discharge valve 25 provided in the main air intake passage 4. The respective supplies of fuel thus divided are discharged through the main discharge valve 25 and the auxiliary discharge valve 26 into the air intake passages 4 and 5, respectively, to thereby form airfuel mixtures, and fed to the combustion chamber of the associated engine 27. The engine 27 in this embodiment is a rotary piston engine in which a triangular piston 29 makes planetary motion in a cavity 28 of two-lobed epitrochoidal shape. Designated at 30 are spark plugs and 31 is an exhaust port. As apparent from the drawing, the main air intake passage 4 is open at a side wall of the cavity 28, said side wall defining working chambers with the piston 29 and a peripheral wall of the cavity, while the auxiliary air intake passage 5 is open at the peripheral wall of the cavity 28.

Figure 2:
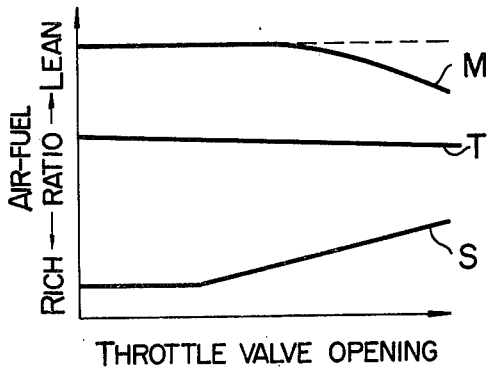
FIG. 2 PRIOR ART
FIG. 2 is a graphic illustration of the characteristics of air-fuel ratio of the fuel system shown in FIG. 1.

With construction of the system described, within the regions of low opening of the main and auxiliary throttle valves 6, 7, a lever 32 of the flow division control means 24 interlocked with said throttle valves is in the state shown in the drawing, the air-fuel mixture produced in the auxiliary air intake passage 5 becomes rich as shown by a curve S and the mixture produced in the main air intake passage 4 becomes lean as shown by a curve M within the regions of low opening of said throttle valves, as seen in the characteristics of air-fuel ratio shown in FIG. 2, because the sectional area of the passageway between the jet needle 22 and the orifice 23 is relatively large.

When the throttle valves 6, 7 are open close to full opening, the lever 32 is rotated on a shaft 33 in the clockwise direction to thereby decrease the sectional area of the passageway between the needle 22 and the orifice 23, whereby the ratio between divided flows directed to the main discharge valve 25 and the auxiliary discharge valve 26 is changed so that the air-fuel mixture on the side of the main air intake passage becomes rich as shown by the curve M in FIG. 2 and the mixture on the side of the auxiliary air intake passage becomes lean as shown by the curve S. However, the ratio between the total flow rate of fuel fed to the discharge valves 25, 26 and the flow rate of air passing through the venturi portion 3 becomes substantially constant irrespective of the opening degrees of the throttle valves through the agency of the fuel pressure control valve means 10 as shown by a curve T in FIG. 2.

If the system shown in FIG. 1 is utilized to obtain the characteristics of air-fuel ratio shown in FIG. 2, then it is theoretically expected to attain a highly accurate control. As described previously however, in practice the accuracy in ratio between the divided flow directed to the main and auxiliary discharge valves are largely influenced by the accuracies in finishing of the needle 22 and the orifice 23, and further, it has been avoidable that the accuracy in control is decreased by gaps formed within the interlocking mechanism portion because the flow division control means 24 is interlocked with the throttle valves 6, 7 by means of the links.

The present invention contemplates that the flow division control means as the root of the above drawbacks is dispensed with, and the discharge valves themselves are made to have the flow division control function by changing the respective flow rate characteristics of the main and auxiliary discharge valves because supplies of fuel fed to the discharge valves are always under positive pressure in the carburetor used in the stratified charge combustion engine having the fuel pressure control means, thereby enabling to obtain the desired characteristics as shown in FIG. 2.

Figure 3:
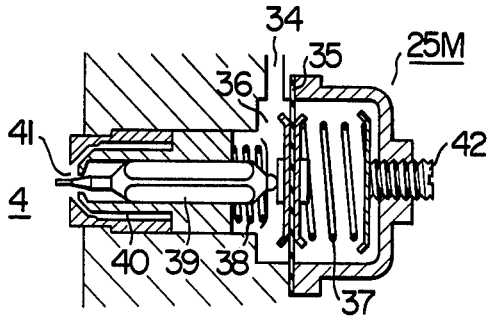
FIG. 3 and FIG. 5 are cross-sectional views of the main and auxiliary discharge valves used as a pair in one embodiment of the present invention.

Next, description will hereunder be given of the first embodiment of the present invention with reference to FIG. 3 to FIG. 6. FIG. 3 illustrates a main discharge valve 25M mounted and open at a wall surface of the main air intake passage 4. A fuel passage 34 is maintained in communication with the downstream compartment 16 of the fuel pressure control valve means 10 shown in FIG. 1. A supply of fuel fed to the main discharge valve 25M enters a control chamber 36 isolated from atmosphere by means of a diaphragm 35. When the fuel pressure exceeds a predetermined value, compressing a spring 37 to move the diaphragm 35 to the right, a needle 39 is thus moved to the right by means of a valve-opening spring 38, injecting the fuel into the main air intake passage 4 through a discharge port 41 formed between a needle 39 and a nozzle 40. Setting of the fuel pressure at a value for causing the discharge valve to start discharging is made by changing the initial deflection value of the spring 37 by means of an adjusting screw 42.

Figure 5:
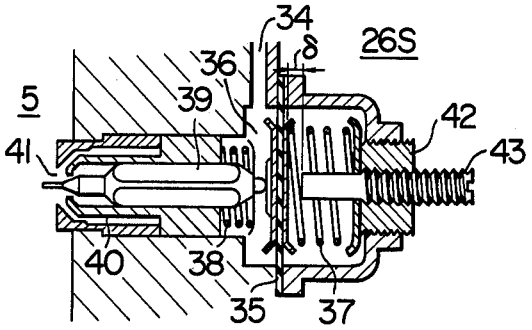
Figure 6:
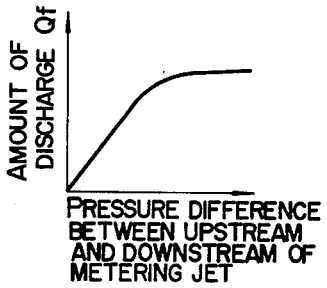
FIG. 6 is a graphic illustration of the flow rate characteristics of the auxiliary discharge valve shown in FIG. 5.

FIG. 5 illustrates construction of an auxiliary discharge valve 26S mounted on the auxiliary air intake passage 5. The basic construction thereof is similar to that of the main discharge valve 25M, but, there is such a difference therebetween that the latter is provided therein with a stopper 43 for preventing the displacement of the diaphragm 35 beyond a predetermined value $\epsilon$ in its displacement. Said main and auxiliary discharge valves are combined with the fuel pressure control valve means 10.

Figure 4:
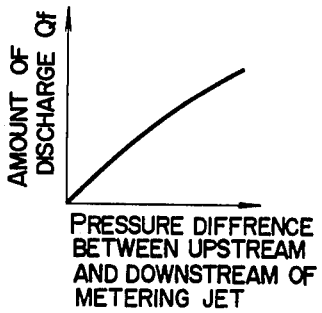
FIG. 4 is a graphic illustration of the flow rate characteristics of the main discharge valve shown in FIG. 3.

FIG. 4 is a graphic illustration of the flow rate characteristics of the main discharge valve 25M, where the amount of discharge is increased in proportion to the pressure difference between the portions upstream and downstream of the metering jet 14. However, the auxiliary discharge valve 26S shows such characteristics that the amount of discharge is in proportion to the pressure difference between the portions upstream and downstream of the metering jet within the region of a small pressure difference, but the rate of increase in discharge amount becomes low within the region of a large pressure difference. This is because the stopper 43 provided in the auxiliary discharge valve 26S prevents the displacement of the diaphragm 35 beyond the predetermined value $\delta$ in its displacement, thereby making the sectional area of the discharge port 41 constant. Consequently, in the case that operation is made within the region of a small pressure difference between the portions upstream and downstream of the metering jet 14, that is, the flow rate of air passing through the venturi portion 3 is low, supplies of fuel in proportion to the flow rate of intake air are discharged from the main and auxiliary discharge valves 25M, 26S, thus making the air-fuel ratio constant. At this time, in order to make lean the air-fuel mixture produced in the main air intake passage 4 and make rich the mixture produced in the auxiliary air intake passage 5, the flow dividing ratio of air after passing through the venturi portion is appropriately selected.

When the flow rate of intake air into the engine is increased and the pressure difference between the portions upstream and downstream of the metering jet is increased, the flow rate of the discharge through the auxiliary discharge valve 26S reaches the ceiling in flow rate. However, finally the mixture on the side of the auxiliary air intake passage 5 becomes lean because the ratio between divided flows of air passing through the venturi portion 3 is constant. On the other hand, the total flow rate of fuel fed to the main and auxiliary discharge valves is in proportion to the flow rate of intake air and hence the mixture in the main air intake passage becomes rich in proportion as the mixture in the auxiliary air intake passage becomes lean. Consequently, the resulting air-fuel ratio can satisfy the characteristics shown in FIG. 2.

Next, description will hereunder be given of the second embodiment shown in FIG. 7 to FIG. 11.

Figure 7:
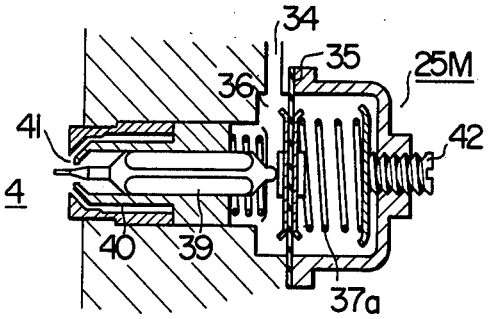
FIG. 7 and FIG. 9 are cross-sectional views of the main and auxiliary discharge valves used as a pair in second embodiment of the present invention.
Figure 8:
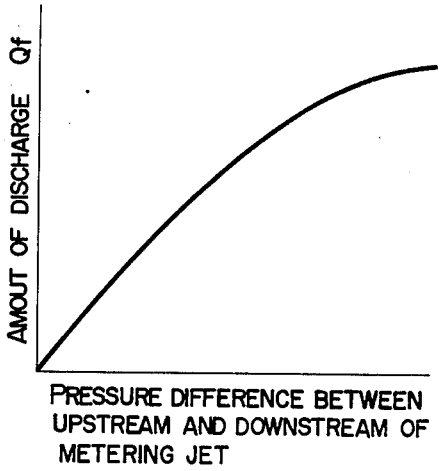
FIG. 8 is a graphic illustration of the flow rate characteristics of the main discharge valve shown in FIG. 7.
Figure 9:
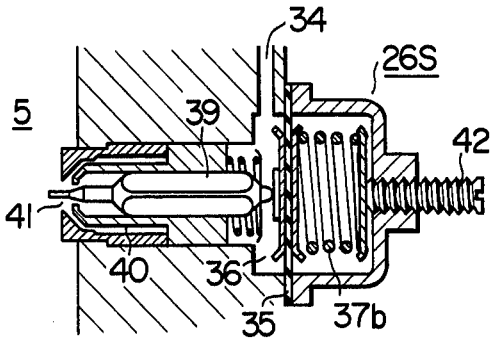
Figure 10:
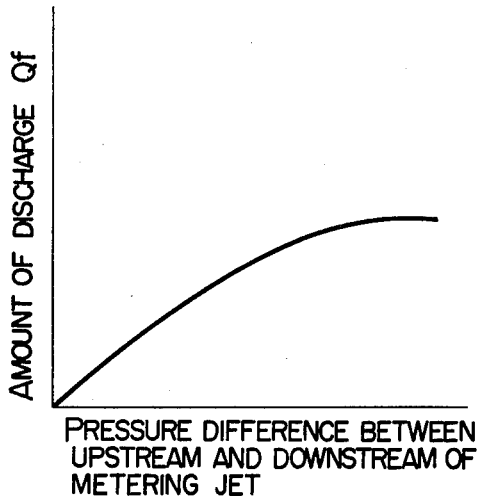
FIG. 10 is a graphic illustration of the flow rate characteristics of the auxiliary discharge valve shown in FIG. 9.
Figure 11:
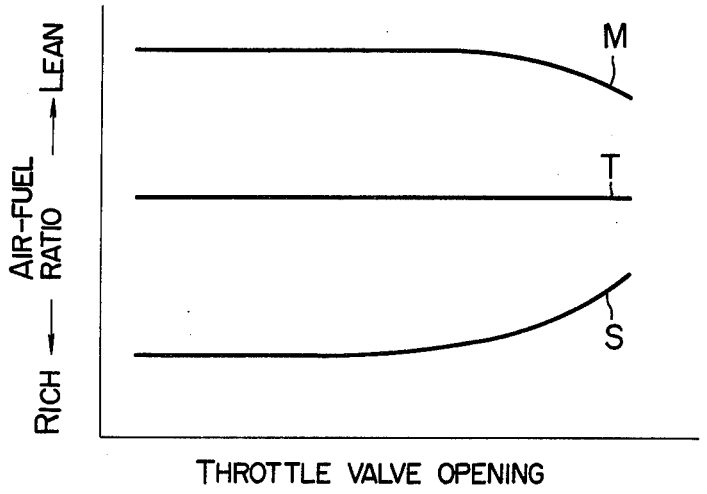
FIG. 11 is a graphic illustration of characteristics of air-fuel ratio of the second embodiment.

The constructions of the main discharge valve 25M shown in FIG. 7 and the auxiliary discharge valve 26S shown in FIG. 9 in this embodiment are substantially same as that in the first embodiment. However, in the first embodiment, the stopper 43 is used in the auxiliary discharge valve 26S whereas in this embodiment, the spring constant ka of a spring 37a in the main discharge valve 25M is set at a value less than the spring constant kb of a spring **37*b* in the auxiliary discharge valve 26S. Said main and auxiliary discharge valves in the second embodiment have the same configurations as that in the first embodiment in other respects. Similarly to the first embodiment, the main and auxiliary discharge valves respectively shown in FIGS. 7 and 9 as a pair is combined with the fuel pressure control valve means 10 shown in FIG. 1. FIG. 8 illustrates the flow rate characteristics of the main discharge valve 25M and FIG. 10 the flow rate characteristics of the auxiliary discharge valve 26S. In both discharge valves, the flow rates of discharge are increased with the increase of the pressure difference between the portions upstream and downstream of the metering jet 14. However, the value of displacement of the diaphragm 35 of the main discharge valve becomes larger than that of the diaphragm of the auxiliary discharge valve as against the same pressure difference between the portions upstream and downstream of the metering jet because the spring constant ka of the spring 37*a* in the main dischage valve 25M is less than the spring constant kb of the spring 37*b* in the auxiliary discharge valve. Consequently, the sectional area of the discharge port 41 formed between the needle 39 and the nozzle 40 becomes larger than that of the auxiliary discharge valve, thus making the flow rate of discharge through the main discharge valve larger than that through the auxiliary discharge valve. FIG. 11 illustrates the air-fuel ratio characteristics in the case that said main and auxiliary discharge valves are combined. In FIG. 11, a curve M illustrates the air-fuel ratio characteristics of the mixture produced in the main air intake passage 4, a curve S the air-fuel ratio characteristics of the mixture produced in the auxiliary air intake passage 5, a curve T the ratio between the total flow rate of fuel fed to the discharge valves 25M, 26S and the flow rate of air passing through the venturi portion. It is noticed that the mixture produced in the auxiliary air intake passage 5 becomes rich. This is because in the ratio between divided flows of air passing through the venturi portion, the flow rate of air in the auxiliary air intake passage is less than that in the main air intake passage as shown in FIG. 1**.

As described above, the desired air-fuel ratio characteristics can be also attained by setting the spring constants ka, kb of the springs **37*a*, 37*b*** in the main and auxiliary discharge valves as $ka < kb$.

As apparent from the foregoing, it should be understood that according to the present invention the flow division control means in the conventional carburetor of this kind can be dispensed with and the desired air-fuel ratio characteristics can be achieved by use of the characteristics of the discharge valves.

What is claimed is:

1. A carburetor for a stratified charge combustion engine of the type wherein a fuel pressure control valve is provided which is adapted to change a pressure difference between the portions upstream and downstream of a metering jet in proportion to the variations of negative pressure produced at a venturi portion provided in a passage for feeding air to an associated engine and a supply of fuel passing through the metering jet is divided and respectively supplied to a diaphragm type main discharge valve and a diaphragm type auxiliary discharge valve respectively provided in a main air intake passage and an auxiliary air intake passage both of which are provided downstream of said venturi portion, the improvement comprising:

valve adjustment means for causing air-fuel ratios of mixtures produced in the main air intake passage and the auxiliary air intake passage by said main and auxiliary discharge valves, respectively, to be changed in different manners by said fuel pressure control valve in response to the change of fuel pressure supplied to said main and auxiliary discharge valves, respectively, by changing the respective flow rates of fuel supplied by the main and auxiliary discharge valves in different manners while maintaining the resultant combined air-fuel ratio supplied to said engine substantially constant, thereby eliminating the need for any other fuel flow division control means.

2. A carburetor as set forth in claim 1, characterized in that: said adjustment means includes a stopper provided in said auxiliary discharge valve for restricting the displacement of the diaphragm thereof such that said restriction is applied at a fuel pressure lower than the fuel pressure at which the flow rate of the fuel discharged from the main discharge valve becomes maximum.

3. A carburetor as set forth in claim 2, characterized in that said stopper is adjustably mounted.

4. A carburetor as set forth in claim 1, characterized in that said adjustment means comprises springs housed in chambers of said main and auxiliary discharge valves, the spring constant of the spring of said main discharge valve being set differently from that of the auxiliary discharge valve.

* * * * *